United States Patent [19]

Halliburton

[11] 4,265,501

[45] May 5, 1981

[54] MODULAR SHELVING

[76] Inventor: Charles R. Halliburton, 310A Barbara Cir., Chattanooga, Tenn. 37411

[21] Appl. No.: 124,143

[22] Filed: Feb. 25, 1980

[51] Int. Cl.[3] ..... A47B 87/00; A47B 43/00

[52] U.S. Cl. ..... 312/108; 312/111; 312/257 R; 312/258; 108/91; 126/194

[58] Field of Search ..... 312/257 R, 257 SK, 257 A, 312/257 SM, 107, 108, 111, 258; 108/91; 126/194, 126

[56] References Cited

U.S. PATENT DOCUMENTS

| | | | |
|---|---|---|---|
| 1,116,304 | 11/1914 | Lundstrom | 312/108 |
| 1,303,985 | 5/1919 | Straubel | 312/107 |
| 1,340,562 | 5/1920 | Sandmann | 312/108 |
| 3,053,397 | 9/1962 | Bliss | 211/126 |
| 3,672,739 | 6/1972 | Taut | 312/111 |
| 4,099,809 | 7/1978 | Leotta | 312/258 |
| 4,103,782 | 8/1978 | Mayer | 312/107 |
| 4,193,650 | 3/1980 | Gray et al. | 312/108 |

FOREIGN PATENT DOCUMENTS

| | | | |
|---|---|---|---|
| 498195 | 12/1953 | Canada | 312/108 |
| 1230551 | 9/1960 | France | 312/258 |

*Primary Examiner*—Victor N. Sakran

*Attorney, Agent, or Firm*—Alan Ruderman

[57] ABSTRACT

A shelf cabinet assembled from a number of modular shelving units secured together with the aid of splicing members into a sturdy load bearing structure resisting bending and twisting tendencies. Each module includes a pair of side panels hinged to a rear panel so that the side panels can be folded flat onto the rear panel for containerization with a corresponding shelf, splicing members and assembling brackets and bolts. Each side panel has a channel like opening formed in the front edge thereof for receiving a splicing member. Angle brackets are secured to flanges on adjacent side panels and the shelf is positioned with a downwardly extending tongue between the side panel and the bracket and forced against a portion of the splicing member to secure the member in place and provide an integral structure.

6 Claims, 5 Drawing Figures

MODULAR SHELVING

BACKGROUND OF THE INVENTION

This invention relates to sheet metal cabinet construction and more particularly to shelving units that can be stored and transported in a disassembled flat stackable condition and subsequently assembled quickly and readily into an effectively sturdy shelf cabinet structure.

Shelf storage cabinets of metal construction generally are of prefabricated construction so they can be shipped and stored at distribution points in a knock-down condition, and subsequently assembled by the ultimate user. Developments in this area are necessitated by considerations relating to the economic utilization of floor space at the final destination and in transit thereto. Thus, the cabinet should be vertically stackable at the ultimate point of use to provide a maximum of storage space for the alloted area and yet use a minimum of cubic space en route. A difficulty with designs attempting these objectives is the structural weakness of the assembled cabinet. Sufficient structural stiffness to resist twisting and bending tendencies appear lacking in the known constructions. Those cabinets which possess the requisite strength for heavy duty performance utilize structure not adaptable to stacking in transit.

SUMMARY OF THE INVENTION

Consequently, it is a primary object of the present invention to provide a stackable shelving module that can be stored using a minimal storage volume until assembled into a heavy duty large storage capacity cabinet.

It is another object of the present invention to provide a stackable shelving module whereby two or more prefabricated modules initially stored in substantially flat condition can easily and quickly be assembled together into a sturdy storage cabinet.

It is a further object of the present invention to provide a shelving module having foldable side panel members adapted to receive a splicing member for aligning and securing with a vertically adjacent second module.

It is a still further object of the present invention to provide a splicing stiffener for shelving modules adapted to align and strengthen the joint of a pair of vertically superposed and secured sheet metal modules, the splicing stiffener having a configuration adapted to be received within front frame portions of the module and locked in vertical alignment by placement of a shelf vertically supported by the modules.

It is a yet still further object of the present invention to provide a shelving cabinet comprising two or more modules secured together and structurally reinforced by splicing stiffeners vertically positioned within front frame portions of two adjacent modules for strenghtening the joint therebetween, which stiffener is secured in position by placement of a shelf which is carried by the cabinet and secured by a retaining member secured to adjacent modules.

Accordingly, the present invention provides a modular shelving unit that can be packed into a substantially flat condition with a corresponding shelf and which can be quickly and readily assembled into a cabinet section which, with the aid of reinforcing splicing members, can be secured to a similar unit to form a sturdy stiff frame cabinet having load-bearing members wholly within the dimensions of the units. The splicing members are elongated elements snugly receivable within channels formed in the front edges of each side panel of the units. The joint between adjacent units is thereby strengthened and stiffened by full height splicing members which extend between the adjacent units from substantially the vertical center of one unit to the vertical center of the other unit. Half height splicing members extend from substantially the vertical center of the top and bottom units to the respective top and bottom extremities so that the splicing member effectively provide front support posts.

The side panels of the units are each hinged to the rear panel for folding the sides flat against the rear panel until the units are assembled at which time the hinges form a secure connection between the side and rear panels. The folded unit may be packed together with a corresponding shelf in a substantially flat container together with the splicing members and other assembling items. In the packaged condition the required storage volume is approximately one eighth the storage volume provided by the unit when assembled. In the assembled condition the mounting of each shelf secures the splicing sleeve in position to provide a solid frame shelf cabinet with high load bearing capabilities in compression with high resistance against bending and twisting tendencies.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
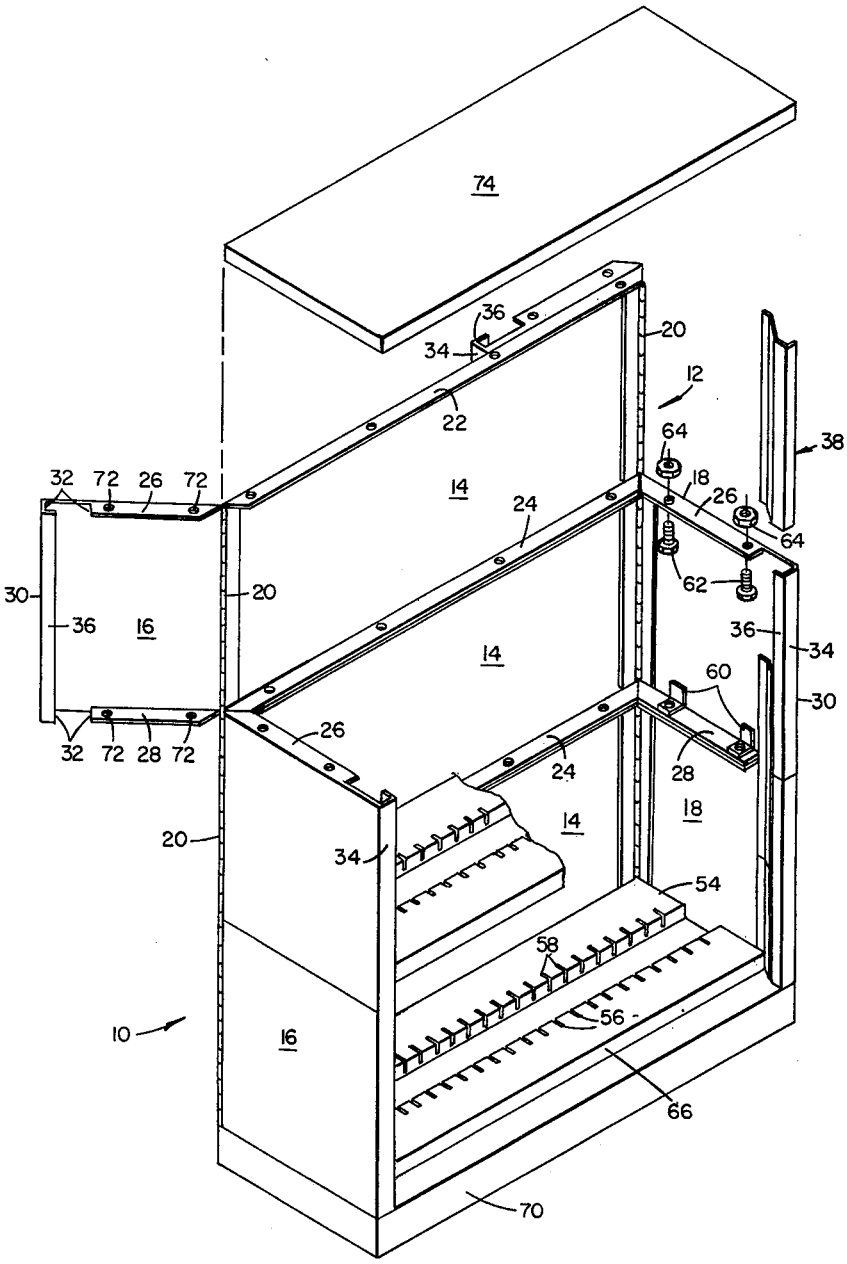
FIG. 1 is a perspective view partly exploded of a portion of a cabinet constructed in accordance with the principles of the present invention and illustrating in various stages of assembly the manner in which the modular units are coupled together.

Referring now to the drawing, FIG. 1 illustrates various aspects of the present invention as utilized for the construction of a shelf cabinet generally designated 10 and comprising a number of shelving modules 12, the modules being vertically stacked in number determined by the storage needs. Each module is made from three sheet metal panels, there being a rear panel 14, a side panel 16, and a side panel 18. Each side panel is connected to the rear panel by a vertically extending hinge member 20 secured to the rear panel 14 and the respective side panel 16,18 by conventional means such as welding so that the three panels comprising the module are structurally integral while allowing for pivotable movement of the side panels relative to the rear panel. Preferably, for reasons hereafter made clear, the side panels can pivot approximately 270° so they can swing from a packaged condition with their outer faces superposed on the rear surface of the rear panel as illustrated at the top module of FIG. 1 and in FIG. 5 to an assembled condition extending forwardly at substantially 90° to the rear panel, as illustrated in the other two modules of FIG. 1.

Each rear panel includes respective upper and lower flanges 22,24 projecting from the forward face thereof and extending substantially the length of the panel. Similarly, each side panel 16 and 18 includes upper and lower flanges 26,28 respectively which extend from the inner face from the rear end adjacent the hinge 20 to a location spaced from the front end 30. A recess 32 is thus defined between the top and bottom flanges 26,28 and the front end 30. The front end 30 of each panel 16,18 has a flange 34 projecting substantially normal from the inner face the entire length of the panel. The flange 34 is turned or bent to form a lip 36 overlying the panel body and extending a short distance toward the rear end of the panel. Thus, a channel is formed in the space between the body of the side panel, the flange 34 and the lip 36 and extends to the leading edges of the upper and lower flanges 26,28 respectively. As hereinafter described in further detail, the channel receives a splicing member 38 for aligning and strengthening the modules when connected in superposed relationship.

Figure 2:
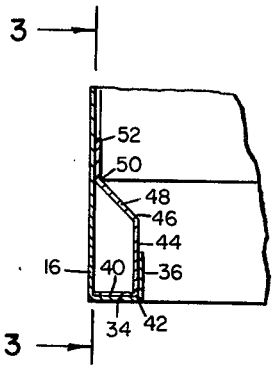
FIG. 2 is a horizontal cross-sectional view taken through the cabinet above one shelf illustrating the disposition of a splicing member relative to the shelf and a side panel of a module.

In the preferred form each splicing member 38 is an elongated sheet metal stiffener having four longitudinally extending sections, each pair of adjacent sections being joined at a bend. The principle of the splicing member is best illustrated in FIG. 2, which although by example shows the member in conjunction with the side panel 16, it should be understood that the same applies equally with regard to side panel 18 which is a mirror image of panel 16, so that the same splicing member may be used therewith when inverted. The member 38 includes a first section 40 of substantially the same width as the spacing in the channel between the lip 36 and the panel body, and is bent at 42 to form a second section 44. The angle of bend at 42 is substantially equal to that between lip 34 and flange 36, i.e., substantially 90°, but the width of the section 44 is greater than that of lip 36. An obtuse angle is formed in section 44 where it is bent at 46 to form the third section 48 which extends back toward the panel 16 and is again bent at 50 to form the fourth section 52 which lies in substantially the same plane as the initial edge of the section 40 and of a width such that the entire member 38 fits snugly within the recess 32. With one exeption, all the splicing members are identical, that exeption being the length. There are provided two different length members, one being substantially one half the length of the other. The half length or half height members are for the top extremities of the top-most modules in a cabinet and for the bottom extremities of the bottom-most modules in a cabinet. This will be further understood as the manner of assembling the modules is described.

Figure 5:
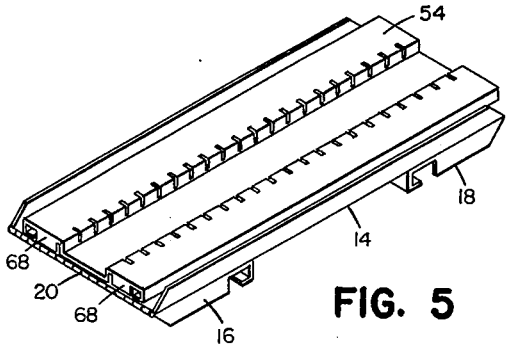
FIG. 5 is a perspective view illustrating a module and a shelf in the packaged condition.
Figure 3:
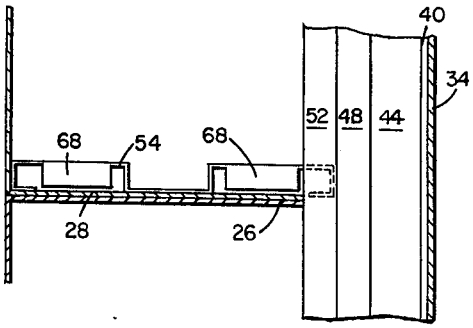
FIG. 3 is a vertical cross-sectional view taken substantially along line 3—3 of FIG. 2.

Each module 12 may be packaged for storage in shipping together with a respective shelf 54 in a substantially flat container, as illustrated in FIG. 5, when the side panels 16 and 18 are folded closed upon the rear panel 14. If the width of the shelf is slightly narrower than the height of the rear panel, it will be located within the border of the rear panel and the thickness of the container need be no more than slightly greater than the combined depth of flanges 22 and 26. The shelf 54 may be of the known adjustable compartment type having two pair of spaced slots 56,58 for receiving divider plates (not illustrated). These plates together with the splicing members 38 and other assembling items, such as brackets 60, screws 62 and bolts 64 may be included within the container between the folded side panels in the space beneath the rear panel. The shelf 54 which conventionally may have a flanged and rolled over edge 66 at the front and rear thereof, may include at least one and preferably two tongues 68 extending downwardly from the plane of the shelf at each end thereof. As hereinafter described, the tongues cooperate with the brackets 60 to secure the shelves in position and thereby provide them as integral parts of the cabinet structure.

Figure 4:
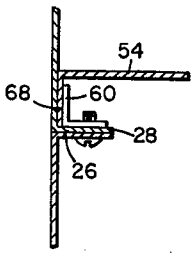
FIG. 4 is a vertical cross-sectional view taken through a portion of a module and illustrating the manner of retaining a shelf.

In assembling the modules into a cabinet a first module is unfolded and placed on a base member 70 with the flanges 28 and 24 resting on the surface of the base and with pre-drilled holes 72 in the flanges aligned with similarly placed pre-drilled holes in the base. Brackets 60 which are pre-drilled angle members are positioned on the flanges 28 with the holes aligned and bolted to the flanges and the base with the screws 62 and nuts 64. A half-height splicing member 38 is thereafter snapped into position within each of the front channels and pushed downwardly into engagement with the base member 70. A shelf 54 is dropped into position with the tongues 68 located between the brackets 60 and the end panels 16 as illustrated in FIG. 4, and similarly positioned with regard to the end panels 18. With the shelf so positioned the splicing member 38 is secured in position by engagement of the shelf with the section 52 of the splicing member. A second module 12 is thereafter unfolded and placed in the proper location with its lower flanges 28 and 24 positioned upon the corresponding upper flanges 26 and 22 of the first module and with the holes 72 of the respective modules in alignment. The two modules are thereafter secured together with respective angle brackets 60 and full height splicing members 38 snapped into position in engagement with the upper edge of the previously installed half-height splicing members at the front corners of the modules. Thus, the full height splicing members extend from substantially mid height of the first module to substantially mid height of the second module. The next shelf 54 is thereafter dropped into position to secure the splicing members and it in turn is secured by the angled brackets. The assembly is continued for as many shelf modules as shelves are desired, with half-height splicing members inserted in the top-most modules prior to positioning of a top or cornice member 74 upon the flanges 26 and 32 and secured in place.

It should be understood that the splicing members 38 because of their configuration and placement form stiffeners for the front joints between each of the modules and at the same time provide additional load bearing structure that is continuous for the entire height of the cabinet and which lies within the dimensions of the storage cube and thus the space allocated for the items to be stored. The stiffening members not only act to resist the twisting and bending tendencies but because of the relationship with the shelves the security of the lateral dimensions of the cabinet are maintained as each module is maintained in proper alignment.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A shelf cabinet comprising at least two adjacent superposed shelving modules interconnected with corresponding shelves into an upstanding structure, each of said modules comprising a rear panel and a pair of side panels, connecting means for securing a substantially vertical edge of the rear panel at each side thereof to a corresponding vertical edge of the side panels to form an open front frame, the upper and lower edge of each side panel having a substantially horizontal flange facing toward the opposite side panel and extending from adjacent said rear panel toward and spaced from the front vertical edge of the side panel, said front vertical edge of each side panel having a substantially vertical flange facing towards the opposite side panel substantially the same distance as said horizontal flanges and terminating in a lip spaced from the plane of the respective side panel, a vertically extending channel being defined within the space between said horizontal and vertical flanges and the lip and the corresponding side panel, a splicing member receivable within each channel and extending vertically into the channel of an adjacent superposed module, said splicing member having surfaces for engaging said vertical flange and lip and for engaging a horizontal flange of the adjacent superposed modules, a shelf secured to adjacent horizontal flanges of said adjacent modules and having an edge abutting said splicing member to secure it in said channel.

2. A shelf cabinet as recited in claim 1 wherein said connecting means comprises a hinge member secured at each side of the rear panel and the adjacent side panel for pivotable movement of each side panel from a folded position overlying said rear panel to an active position substantially perpendicular thereto, whereby said side panels may be folded onto said rear panel for containerization.

3. A shelf cabinet as recited in claim 1 wherein a first of said modules is secured to a base, said splicing member having a length substantially equal to the height of said module panels and positioned within the channel of said first module abutting a second splicing member having a length substantially equal to one half the height of said module panels.

4. A shelf cabinet as recited in claim 2 including an angle bracket having a horizontal leg secured to the substantially horizontal flange of at least one lower edge of a side panel and having an upstanding leg spaced from the plane of the side panel, said shelf having a tongue extending downwardly from the shelf on at least one end thereof, said shelf being disposed on said upstanding leg with the tongue disposed intermediate said upstanding leg and said side panel.

5. A shelf cabinet as recited in claim 3 including a third splicing member having a length substantially equal to that of said second splicing member, said third splicing member being positioned in the upper-most portion of the channel of the module disposed furthest from the base.

6. A shelf cabinet as recited in claim 1 or 2 wherein said splicing member comprises a first section extending a distance substantially equal to the spacing between said lip and said panel disposed in abuttment with said vertical flange, a second section extending from said first section abutting said lip, a third section extending angularly from said second section toward said panel, and a fourth section extending from said third section overlying said panel and abutting said horizontal flanges.

* * * * *